US005820072A

United States Patent [19]

Na et al.

[11] Patent Number: 5,820,072

[45] Date of Patent: Oct. 13, 1998

[54] APPARATUS FOR UNFOLDING AND FIXING MISSILE FINS

[75] Inventors: Moon-Soo Na; Yeol-Wha Lee; Young-Sug Shin; Cheol-Gyu Hwang; Hae-Seogk Yang, all of Daejon, Rep. of Korea

[73] Assignee: Agency For Defense Development, Daejon, Rep. of Korea

[21] Appl. No.: 761,857

[22] Filed: Dec. 9, 1996

[30] Foreign Application Priority Data

Dec. 9, 1995 [KR] Rep. of Korea ..... 48100/1995

[51] Int. Cl.[6] ..... B64C 3/56; F42B 10/14

[52] U.S. Cl. ..... 244/49; 244/3.27; 244/3.28

[58] Field of Search ..... 244/3.29, 3.27, 244/3.28, 49

[56] References Cited

U.S. PATENT DOCUMENTS

| | | | |
|---|---|---|---|
| 2,858,765 | 11/1958 | Startzell | 102/50 |
| 3,273,500 | 9/1966 | Kongelbeck | 102/50 |
| 3,563,495 | 2/1971 | Korn | 244/3.29 |
| 3,952,970 | 4/1976 | Orzechowski et al. | 244/3.23 |
| 4,586,680 | 5/1986 | DiTommaso et al. | 244/3.27 |
| 4,588,145 | 5/1986 | Inglis | 244/3.24 |
| 4,673,146 | 6/1987 | Inglis | 244/3.23 |
| 4,778,127 | 10/1988 | Duchesneau | 244/3.29 |
| 4,884,766 | 12/1989 | Steinmetz et al. | 244/3.27 |
| 5,125,131 | 6/1992 | Leblanc | 16/330 |

FOREIGN PATENT DOCUMENTS

| | | |
|---|---|---|
| 0327680 | 8/1989 | European Pat. Off. . |
| 1270328 | 10/1960 | France . |
| 2949292 A1 | 6/1981 | Germany . |

*Primary Examiner*—V. Lissi Mojica
*Attorney, Agent, or Firm*—Scully, Scott, Murphy & Presser

[57] ABSTRACT

An improved apparatus for unfolding and fixing missile fins which is capable of automatically unfolding the fins of a missile when launching the missile loaded in a missile launch tube, in which the fins of the missile are folded, which includes a plurality of fins fixed to a missile body, a plurality of rotation fins rotatably supported by the fixed fin, rotation stoppers elastically supported in the direction the rotation fins are unfolded, and unfolding and fixing member forwardly and rearwardly movable with respect to the fixed fins and each having a straight movement stopper elastically supported toward the rotation stopper.

13 Claims, 5 Drawing Sheets

APPARATUS FOR UNFOLDING AND FIXING MISSILE FINS

BACKGROUND OF THE INVENTION

1. Field of the Invention

The present invention relates to an apparatus for unfolding and fixing missile fins, and in particular to an improved apparatus for unfolding and fixing missile fins which is capable of automatically unfolding the fins of a missile when launching the missile loaded in a missile launch tube, in which the fins of the missile are folded.

2. Description of the Conventional Art

Generally, the missile loaded in a missile launch tube is supported by a guide rail of the missile launch tube. After the missile is launched from the missile launch tube, the fins thereof are rapidly unfolded and fixed, so that the flying of the missile is guided by the fins fixed to the outer surface thereof.

However, since it is necessary to reduce the weight of the missile and to minimize the drag force of the missile for a small-sized missile, the parts for unfolding and fixing the fins of the missile should be substantially embedded within the body, and the fins of the missile must have a predetermined strength against the air pressure applied thereto.

SUMMARY OF THE INVENTION

Accordingly, it is an object of the present invention to provide an improved apparatus for unfolding and fixing missile fins which overcomes the problems encountered in the conventional apparatus for unfolding and fixing missile fins.

It is another object of the present invention to provide an apparatus for unfolding and fixing missile fins which is capable of automatically and rapidly unfolding the fins of a missile when launching the missile loaded in a missile launch tube, in which the fins of the missile are folded.

To achieve the above objects, there is provided an apparatus for unfolding and fixing missile fins which includes a plurality of fins fixed to a missile body, a plurality of rotation fins rotatably supported by the fixed fin, rotation stoppers elastically supported in the direction the rotation fins are unfolded, and unfolding and fixing member forwardly and rearwardly movable with respect to the fixed fins and each having a straight movement stopper elastically supported toward the rotation stopper.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

The construction of an apparatus for unfolding and fixing the fins of a missile according to the present invention will now be described with reference to the accompanying drawings.

Figure 1:
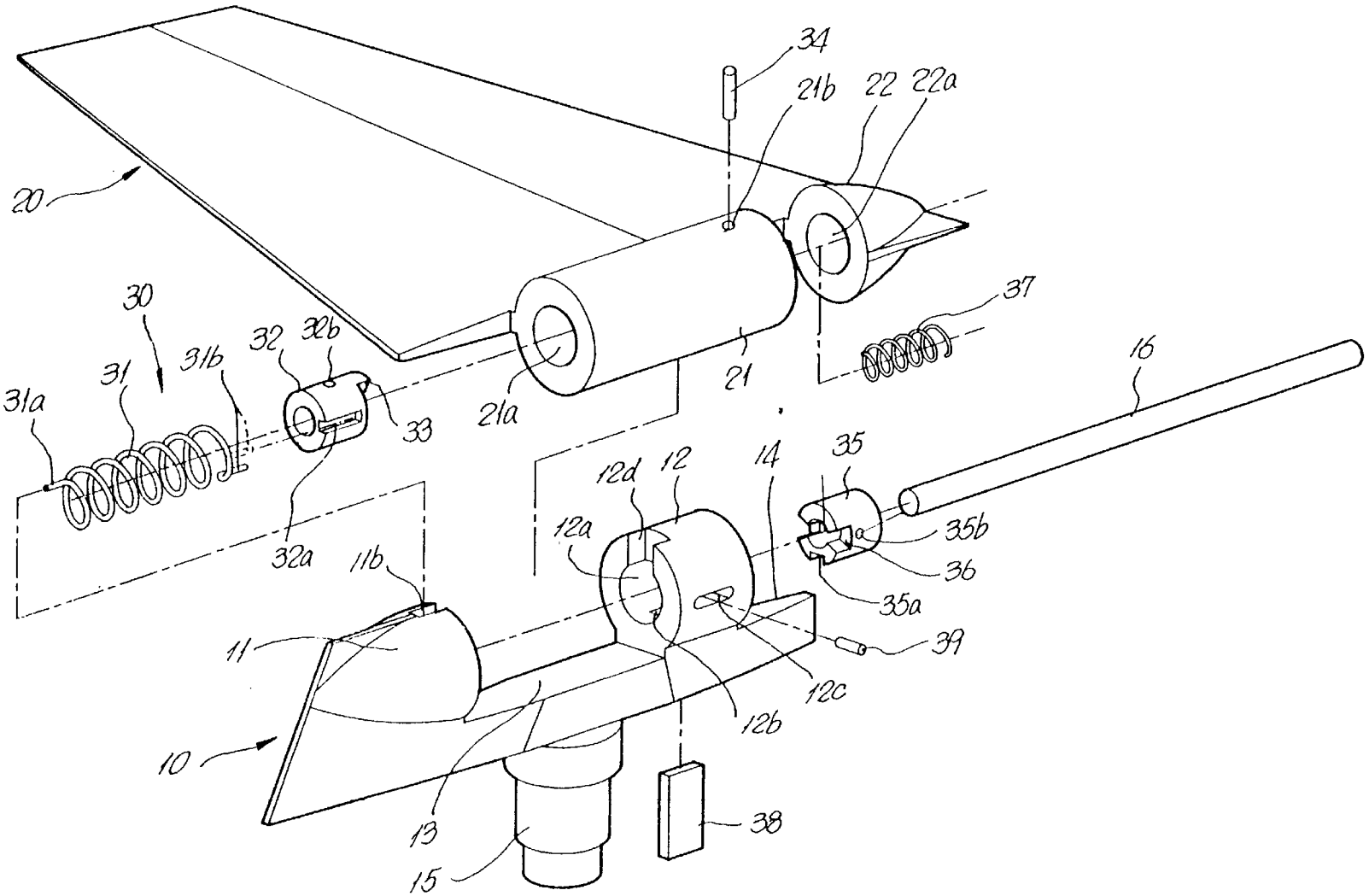
FIG. 1 is a perspective view illustrating an apparatus for unfolding and fixing missile fins according to the present invention.

FIG. 1 is a perspective view showing an apparatus for unfolding and fixing missile fins according to the present invention. As shown therein, the apparatus therefor includes fins 10 fixed to the outer surface of a missile body 1, rotation fins 20 rotatably engaged to the fins 10, and a unfolding and fixing member 30 for fixing and automatically unfolding the rotation fins 20 with respect to the fixed fins 10.

Four fins 10 are radially fixed to the outer surface of the missile body 1 and are spaced-apart at a regular interval.

The rotation fins 20 are rotatable by a hinge shaft 16 with respect to the fixed fin 10.

Here, the fin 10 includes a hinge end portion 11 having a hinge groove 11*a* into which the hinge shaft 16 is inserted, a rear hinge portion 12 having a space 12*a* through which the hinge shaft 16 passes through, and an intermediate cut-away portion 13 and a rear side cut-away portion 14 formed between the hinge portions 11 and 12 and in the end portion of the rear hinge portion 12, respectively.

A spar 15 is formed in the inner portion of the fixed fin 10 for fixing the fins 10 to the missile body 1.

The rotation fins 20 include an intermediate hinge 21, which matches with the intermediate cut-away portion 13, having a space 21*a* through which the hinge shaft 16 passes, and a rear support portion 22, which matches with the rear cut-away portion 14, having a space 22*a* through which the hinge shaft 16 passes and a hinge hole 22*b* into which the end portion of the hinge shaft 16 is inserted and supported thereby.

The unfolding and fixing member 30 includes a torsion spring 31 formed in the intermediate cut-away portion 13 of the fixed fin 10 and wound onto the hinge shaft 16 for elastically supporting the rotation fins 20 in the unfolding direction of the fins, a rotation stopper 32 inserted within the intermediate hinge portion 21 of the rotation fin 20 and being rotatably together with the rotation fin 20, and a straight movement stopper 35 inserted within the rear hinge portion 12 of the fixed fin 10 which is slidable in the forward and backward directions and is elastically supported therein in order for the unfolding state of the rotation fin 20 engaged with the rotation stopper 32 to be secured when the rotation fin 20 is unfolded.

The hinge shaft 16 is inserted into the hinge hole 22*b* formed in the rear hinge portion 22 of the rotation fin 20 from its rear portion to its front portion, with the front portion thereof being supported by the hinge groove 11*a* formed in the hinge end portion 11 of the fixed fin 10, and with the rear portion thereof being supported by the hinge hole 22*b*.

The torsion spring 31 is inserted within the space 21*a* of the intermediate hinge portion 21 of the rotation fin 20 before the hinge shaft 16 is inserted, and the torsion spring 31 is wound onto the hinge shaft 16 when the hinge shaft 16 is inserted.

The front end portion 31*a* of the torsion spring 31 is inserted into the spring fixing groove 11*b* formed in the outer surface of the front end of the hinge end portion 11 of the fixed fin 10 in the radial direction, and the rear portion thereof is inserted into the fixing groove 32*a* formed in the outer surface of the rotation stopper 32.

Here, the outer portion of the cut-away spring fixing groove 11*b* is open in order for the front end portion 31*a* of the torsion spring 31 to be inserted therethrough, and the outer portion of the spring fixing groove 32*a* is open in order for the rear portion 31*b* of the torsion spring 31 to be inserted therethrough. The spring fixing groove 11*b* is formed just below a root chord 20*a* of the rotation fin 20 so as to prevent any interference of air flow when the missile flies in a state that the fins are unfolded.

A pair of engaging protrusions 33, one of which is shown in FIG. 1, are formed in the rear portion of the rotation stopper 32, and an engaging groove 36 to which the engaging protrusion 33 is engaged is formed in the front end surface of the straight movement stopper 35, and the engaging protrusion 33 contacts with the front end portion of the straight movement stopper 35 in a state that the rotation fin 20 is folded, and the rotation fin 20 is engaged to the engaging groove 36, and maintains a state that the rotation fin 20 is unfolded.

The engaging protrusion 33 and the engaging groove 36 are disposed in a position where there is a 180° phase difference therebetween, so the range of the rotation angle of the rotation fin 20 exceeds 90°.

Here, the engaging protrusion 33 is formed in the rotation stopper 32, and the engaging groove 36 is formed in the straight movement stopper 35. However, the installations thereof are not limited thereto. Namely, the positions therebetween may be changed.

The rotation stopper 32 is inserted into the intermediate hinge portion 21 of the rotation fin 20, and is integral with the intermediate hinge portion 21 and the rotation stopper 32 by inserting the pin hole 21*b* formed in the wall of the intermediate hinge portion 21 and the pin hole 32*b* formed in the wall of the rotation stopper 32.

The straight movement stopper 35 is slidable within the space 12*a* formed in the rear hinge portion 12 of the fixed fin 10, and is forwardly and elastically supported by a compression spring.

The compression strength of a compression spring 37 is greater than the compression strength of the torsion spring 31.

The straight movement stopper 35 is forwardly and backwardly movable, with the height of the engaging groove 36 and its circumferential surface being constant. A key guide groove 35*a* is radially formed in the inner portion of the wall of the straight movement stopper 35, and a square-shaped key 38 is inserted into the key guide groove 35*a* through the key through hole 12*b* formed in the inner portion of the fixed fin 10, so that the straight movement stopper 35 becomes linearly, forwardly, rearwardly movable.

A protrusion guide groove 12*d*, by which the engaging protrusion 33 is guided, is formed in an outer portion of the rear hinge portion 12 in the radial direction. The protrusion guide groove 12*d* is positioned just below the root chord 20*a* of the rotation fin 20 in order for the air flow resistance to be minimized when the missile flies, with the fins of the missile being unfolded.

A tool guide hole 12*c* is formed in a portion of the wall of the rear hinge portion 12, and a tool insertion hole 35*b* is formed in an outer portion of the straight movement stopper 35 in order for the straight movement stopper 35 to be backwardly moved by inserting a tool 39 into the tool insertion hole 34*b* and by backwardly pulling the same to overcome the elastic force of the compression spring 37.

Figure 2:
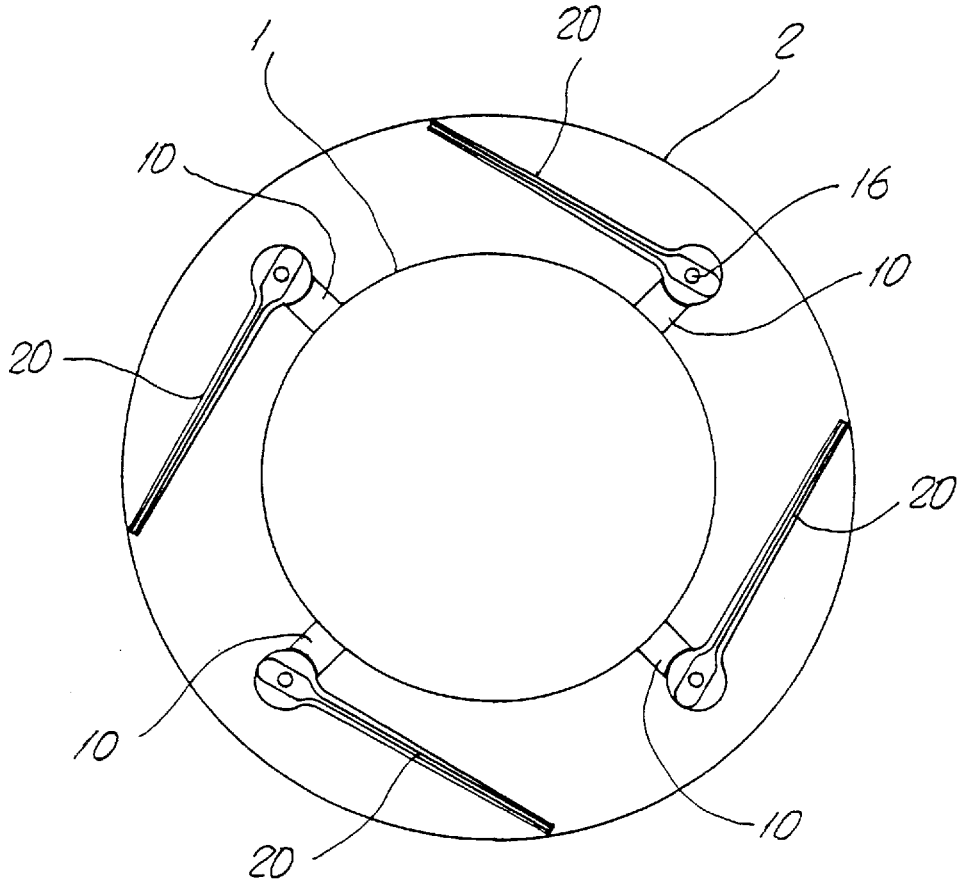
FIG. 2 is a cross-sectional view illustrating that the fins of a missile are folded and arranged in a missile launch tube according to the present invention.

In FIG. 2, reference numeral 2 denotes a missile launch tube.

The order of the assembling of an apparatus for unfolding and fixing missile fins according to the present invention will now be explained.

First, the straight movement stopper 35 is inserted into the space 12*a* of the rear hinge portion 12 of the fixed fin 10, and the inner end portion of the square-shaped key 38 is inserted into the key guide groove 35*a* of the straight movement stopper 35 by inserting the square-shaped key 38 through the key through hole 12*b*, so that only lineal movement of the straight movement stopper 35 is made.

The torsion spring 31 and the rotation stopper 32 are inserted into the space 21*a* of the intermediate hinge portion 21 of the rotation fin 20, and the front end portion 31*a* of the torsion spring 31 is inserted into the spring fixing groove 11*b* of the front end portion 11, and the rear portion 31*b* thereof is inserted into the spring fixing groove 32*a* of the rotation stopper 32, and the fixing pin 34 is inserted into the pin hole 21*b* formed in the intermediate hinge portion 21 and is inserted into the pin hole 32*b* of the rotation stopper 32, whereby the rotation stopper 32 is fixed to the intermediate hinge portion 21 of the rotation fin 20.

In a state that the compression spring 37 is inserted into the space 22*a* of the rear hinge portion 22 of the rotation fin 20, the rotation fin 20 is fitted to the intermediate cut-away portion 13 of the fixed fin 10, and the rear hinge portion 22 is fitted to the rear cut-away portion 14 of the fixed fin 10, then hinge shaft 16 is inserted into the rear cut-away portion 14 of the fixed fin 10 through the hinge hole 22*b* of the rear hinge portion 22 of the rotation fin 20.

Here, since the engaging protrusion 33 of the rotation stopper 32 is protruded from the rear portion of the intermediate hinge portion 21 of the rotation fin 20, and the engaging protrusion 33 is guided by the protrusion guide groove 12*d* formed in the rear hinge portion 12 of the fixed fin 10, the engaging protrusion 33 is not interfered by the rear hinge portion 12.

Meanwhile, since the straight movement stopper 35 is forwardly and elastically supported by the compression spring 37, when the rotation stopper 32 is fitted, there occurs an interference therebetween. In addition, the straight movement stopper 35 is backwardly moved by inserting the tool 39 into the tool insertion hole 35*b* of the straight movement stopper 35 through the tool guide hole 12*c* and by backwardly pulling the same. As a result, the rotation stopper 32 is not interfered by the straight movement stopper 35.

The hinge shaft 16 is inserted into the hinge groove 11*a*, with its front end portion being formed in the front end hinge portion 11, through the compression spring 37, the straight movement stopper 35, the rotation stopper 32, and the torsion spring 31, and the rear portion thereof is supported by the hinge hole 22*b* of the rear hinge portion 22.

In the above-mentioned state, the rotation stopper 32 is inserted into the intermediate hinge portion 21 of the rotation fin 20, and the rotation stopper 32 is supported by the key 38 inserted into the key through hole 12*b* of the fixed fin 10, and none of the parts and portions are protruded toward the outside. In addition, since the compression spring 37 is disposed in the rear portion of the rotation fin 20 for elastically supporting the straight movement stopper 35, the fin is shaped as a streamline which is characterized to minimize the air flow resistance.

In a state that the assembling process is finished, when rotating and folding the rotation fin 20, the tool 39 is inserted into the tool guide hole 12*c* formed in the rear hinge portion 12 of the fixed fin 10, and the front end portion thereof is fitted to the tool insertion hole 35*b* of the straight movement stopper 35. Thereafter, the straight movement stopper 35 is backwardly moved when backwardly pulling the tool 39, and the engaging groove 36 does not interfere with the engaging protrusion 33 of the rotation stopper 32.

Figure 3A:
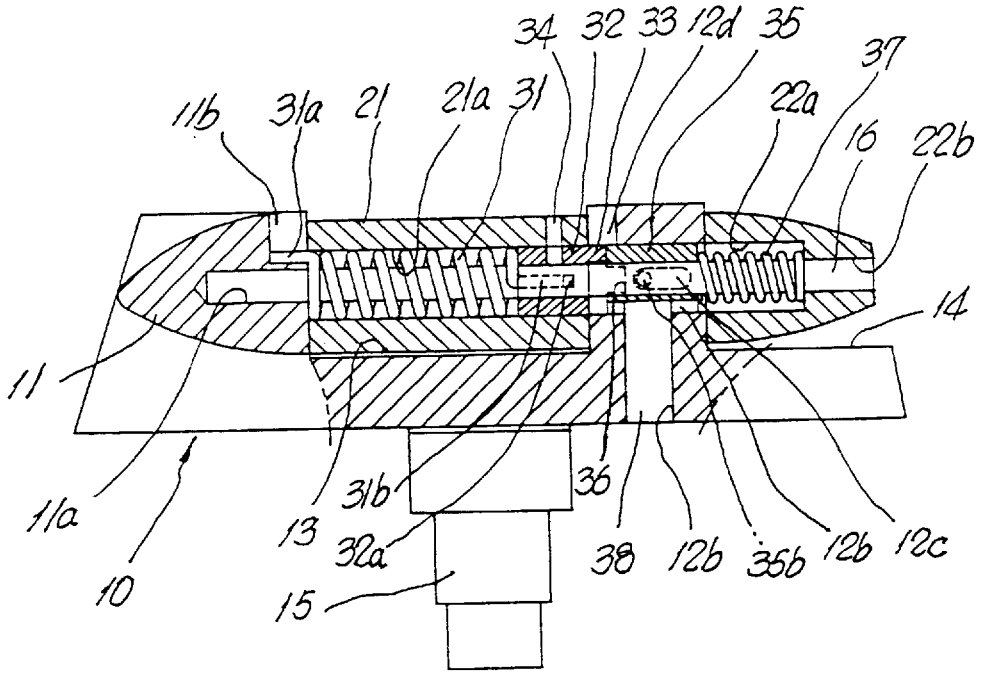
FIGS. 3A and 3B are side and bottom views illustrating that the fins of a missile are folded by an apparatus for unfolding and fixing missile fins according to the present invention.
Figure 3B:
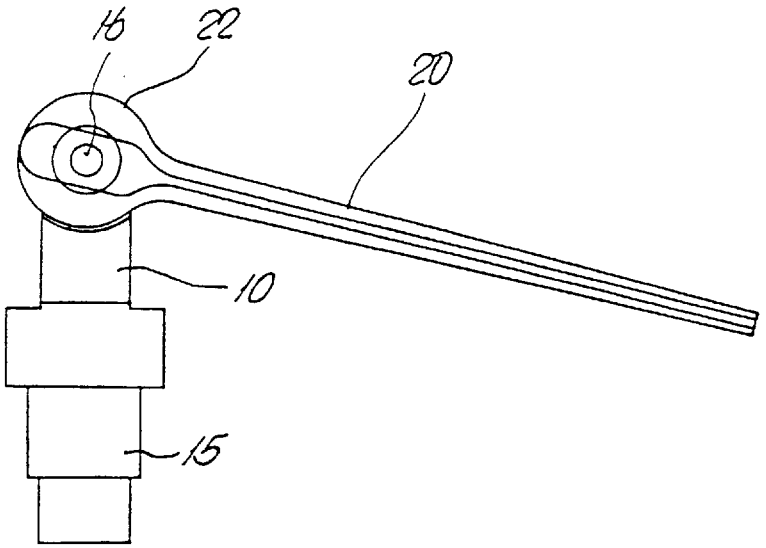

In the above-described state, when rotating the rotation fin 20, as shown in FIG. 3A, the front end portion of the engaging protrusion 33 of the rotation stopper 32 comes into contact with the front end surface of the straight movement stopper 35.

Here, when rotating and folding the rotation fin 20, the torsion spring 31 is twisted, with the rear portion 31*b* thereof being fixed to the rotation stopper 32 integrally engaged with the rotation fin 20. Therefore, the torsion spring 31 becomes free, stores a torsion recovering force as indicated by the full line in FIG. 1, and becomes the state as indicated by the virtual line shown in FIG. 1. This torsion recovering force serves to unfold the rotation fin 20, with the force being applied thereto through the rotation stopper 32.

In a state that the rotation fin 20 is folded, when loading the missile body 1 into the missile launch tube 2, the end portion of the rotation fin 20 contacts with the inner surface of the missile launch tube 2, and the rotation fin 20 is not unfolded by the torsion recovering force of the torsion spring 31.

Figure 4A:
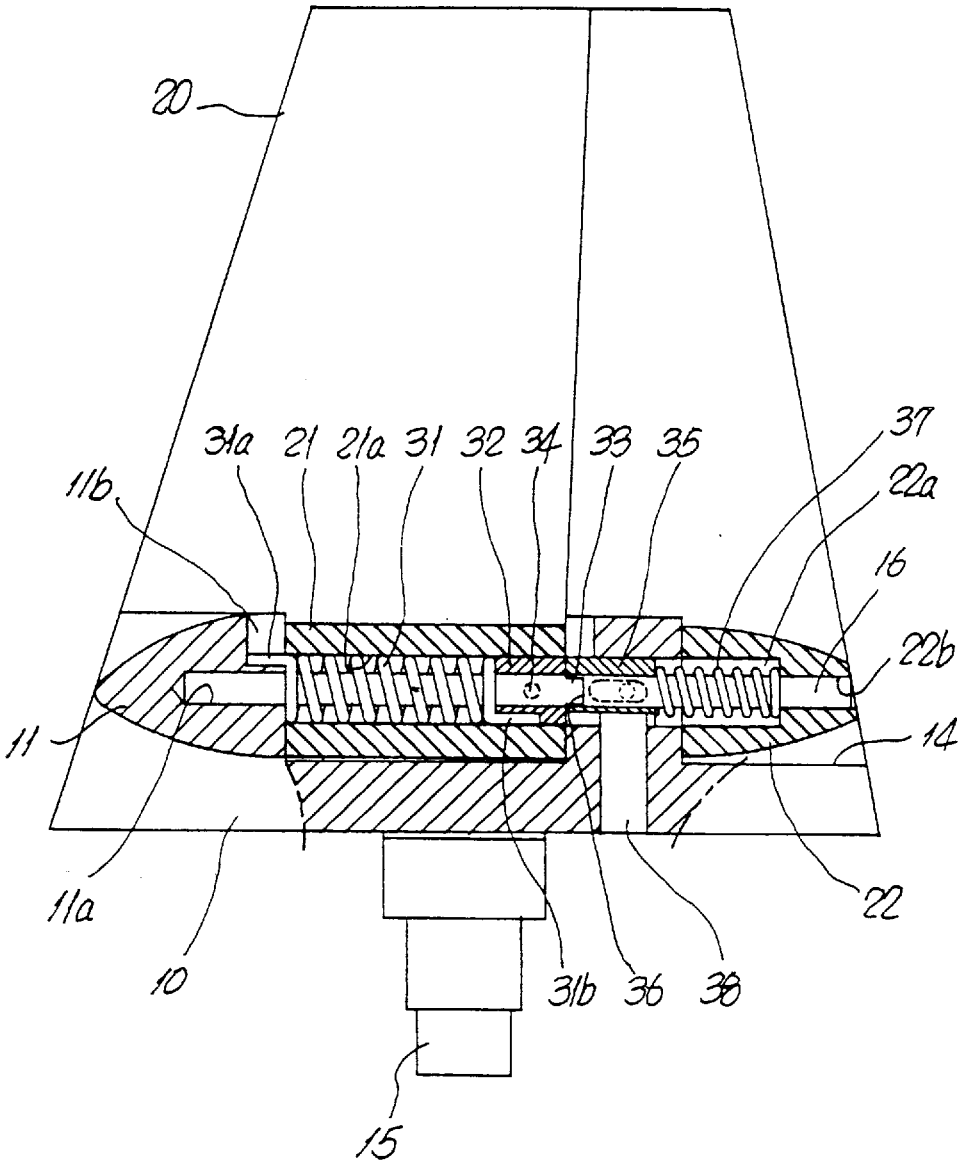
FIGS. 4A and 4B are side and bottom views illustrating that the fins of a missile are unfolded by an apparatus for unfolding and fixing missile fins according to the present invention.
Figure 4B:
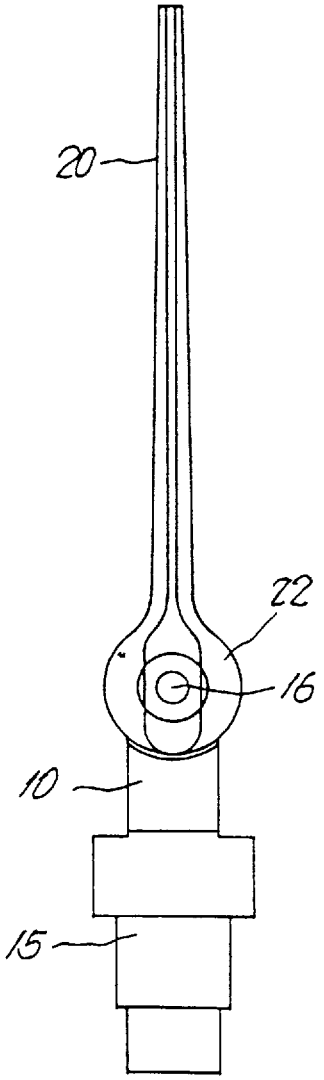

When the missile is launched from the missile launch tube 2, the end portion of the rotation fin 20 is escaped from the inner surface of the missile launch tube 2 at the moment when the fin portion is took off from the front end portion of the missile launch tube 2, so that the rotation fin 20 is rotated by the torsion recovering force of the torsion spring 31, and is unfolded as shown in FIGS. 4A and 4B.

Here, the fin unfolding process will now be explained in more detail. The rotation stopper 32 is rotated in the unfolding direction about the hinge shaft 16 by the torsion recovering force of the torsion spring 31 at the moment when the rotation fin 20 is escaped from the front end portion of the missile launch tube 2, and the rotation fin 20 fixed to the rotation stopper 32 by the fixing pin 34 is rotated.

Here, when the rotation stopper 32 is rotated in the unfolding direction, the front end portion of the engaging protrusion 33 contacts with the front end portion of the straight movement stopper 35, and reaches the engaging groove 36 of the straight movement stopper 35, the straight movement stopper 35 forwards by the compression spring 37. Thereafter, the engaging protrusion 33 of the rotation stopper 32 is engaged to the engaging groove 36 of the straight movement stopper 35, and is not moved. As a result, the rotation fin 20 integral with the rotation stopper 32 is not moved.

In a state that the rotation fin 20 is unfolded, since the torsion recovering force of the straight movement stopper 35 of the torsion spring 31 is widely applied over the square-shaped key 38 and the key through hole 12*b* of the fixed fin 10, it is possible fabricate a compact size of the system and an apparatus having a high strength.

Thereafter, the missile flies, with the fins thereof being unfolded. Since the rotation fin 20 is engaged to the engaging groove 36 of the straight movement stopper 35 in which the engaging protrusion 33 of the rotation stopper 32 is forwardly and elastically supported by the compression spring 37, the rotation fin 20 is not folded during the flight.

Since the spring fixing groove 11*b* having the portion opened in the radial direction of the fixed fin 10 and the protrusion guide groove 12*d* are positioned just below the root chord 20*a* of the rotation fin 20, it is possible to minimize the air flow resistance.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. An apparatus for unfolding and fixing missile fins, comprising:

a plurality of fins fixed to a missile body;

a plurality of rotation fins rotatably supported by the fixed fin;

rotation stoppers elastically supported in the direction the rotation fins are unfolded;

unfolding and fixing means forwardly and rearwardly movable with respect to the fixed fins and each having a straight movement stopper elastically supported toward the rotation stopper;

a front end hinge portion having a hinge groove;

a rear hinge portion having a space within which the straight movement stopper is forwardly and backwardly movable;

intermediate cut-away and rear cut-away portions positioned between the hinge portions and at the rear portion of the rear hinge portion, respectively;

an intermediate hinge portion, which corresponds to the intermediate cut-away portion of the fixed fin, formed in the rotation fin and having a space into which the rotation stooper is fixedly inserted;

a rear hinge portion which corresponds to the rear cut-away portion of the fixed fin and having a hinge hole; and a hinge shaft of which both sides are supported by the hinge groove and the hinge hole with respect to the fixed fin.

2. The apparatus of claim 1, wherein a tool guide hole is formed in one side of the wall of the rear hinge portion of the fixed fin, and a tool insertion hole is formed in an outer surface of the straight movement stopper, so that the tool for backwardly moving the straight movement stopper is inserted into the tool insertion hole through the tool guide hole.

3. The apparatus of claim 1, wherein said rotation fin is inserted into the intermediate hinge portion, with one end a torsion spring being fixed to the front end hinge portion, and the other end thereof being fixed to the rotation stopper integrally engaged with the rotation fin.

4. The apparatus of claim 3, wherein said torsion spring includes a front end portion inserted into a spring fixing groove, with a front end portion thereof being radially opened to the outside of the front end hinge portion, and a rear portion inserted into a spring fixing groove formed in an outer surface of the rotation stopper.

5. The apparatus of claim 1, wherein said space is formed in the rear hinge portion of the rotation fin, with a compression spring elastically supporting the straight movement stopper toward the rotation stopper being inserted into the space.

6. The apparatus of claim 1, wherein said rotation stopper is integrally engaged with the rotation fin by a fixing pin passing through the intermediate hinge portion of the rotation fin.

7. The apparatus of claim 1, wherein a key guide groove is formed in the outer surface of the straight movement stopper, with a square-shaped key passing through a key through hole formed in the inside of the rear hinge portion of the fixing fin and being inserted into the key guide groove.

8. The apparatus of claim 1, wherein an engaging protrusion and an engaging groove are formed in the rotation stopper and the straight movement stopper, respectively.

9. The apparatus of claim 7, wherein an engaging protrusion and an engaging groove are formed in the rotation stopper and the straight movement stopper, respectively.

10. The apparatus of claim 8, wherein said engaging protrusion and said engaging grooves have a 180° phase difference, respectively, with the number of each of the engaging protrusion and the engaging groove being two.

11. The apparatus of claim 1, wherein a protrusion guide groove by which the engaging protrusion of the rotation stopper is guided is formed in the outer portion of the rear hinge portion of the fixed fin.

12. The apparatus of claim 7, wherein a protrusion guide groove by which the engaging protrusion of the rotation stopper is guided is formed in the outer portion of the rear hinge portion of the fixed fin.

13. The apparatus of claim 7, wherein a tool guide hole is formed in one side of the wall of the rear hinge portion of the fixed fin, and a tool insertion hole is formed in an outer surface of the straight movement stopper, so that the tool for backwardly moving the straight movement stopper is inserted into the tool insertion hole through the tool guide hole.

* * * * *